US008336255B2

(12) United States Patent
Shimizu et al.

(10) Patent No.: US 8,336,255 B2
(45) Date of Patent: Dec. 25, 2012

(54) OPENING AND CLOSING APPARATUS

(75) Inventors: Masaaki Shimizu, Toyohashi (JP); Ryousuke Sakamaki, Kosai (JP)

(73) Assignee: Asmo Co., Ltd., Kosai-shi, Shizuoka-ken (JP)

( * ) Notice: Subject to any disclaimer, the term of this patent is extended or adjusted under 35 U.S.C. 154(b) by 242 days.

(21) Appl. No.: 12/870,153

(22) Filed: Aug. 27, 2010

(65) Prior Publication Data

US 2011/0047879 A1 Mar. 3, 2011

(30) Foreign Application Priority Data

Sep. 1, 2009 (JP) ..... 2009-201716

(51) Int. Cl.
*E05F 15/02* (2006.01)

(52) U.S. Cl. ..... 49/27; 49/28; 49/490.1; 49/360

(58) Field of Classification Search ..... 49/26, 27, 49/28, 360, 490.1, 498.1; 200/61.43
See application file for complete search history.

(56) References Cited

U.S. PATENT DOCUMENTS

| | | | | |
|---|---|---|---|---|
| 4,413,033 | A * | 11/1983 | Weichman | 428/122 |
| 6,339,305 | B1 * | 1/2002 | Ishihara et al. | 318/445 |
| 6,761,954 | B2 * | 7/2004 | Hauser | 428/108 |
| 7,958,672 | B2 * | 6/2011 | Ishihara | 49/26 |
| 8,159,231 | B2 * | 4/2012 | Sakamaki | 324/663 |
| 8,191,311 | B2 * | 6/2012 | Sakamaki et al. | 49/27 |
| 2004/0107640 | A1 * | 6/2004 | Ishihara et al. | 49/27 |
| 2006/0191203 | A1 * | 8/2006 | Ueda et al. | 49/27 |
| 2007/0113481 | A1 * | 5/2007 | Kato et al. | 49/360 |
| 2009/0267786 | A1 * | 10/2009 | Sakamaki et al. | 340/686.6 |

FOREIGN PATENT DOCUMENTS

JP 2000-292279 A 10/2000

* cited by examiner

*Primary Examiner* — Jerry Redman
(74) *Attorney, Agent, or Firm* — Marsh Fischmann & Breyfogle LLP

(57) ABSTRACT

An opening and closing apparatus is disclosed that includes an opening and closing body, a force transmitting portion, an elongated sensor body, a support member, and a control section. The opening and closing body is actuated to selectively open and close an opening. The force transmitting portion has a drive portion that generates drive force. The force transmitting portion transmits the drive force from the drive portion to the opening and closing body. The sensor body detects an object between a closing-side end of the opening and closing body and a facing part of the periphery of the opening that faces the closing-side end of the opening. The closing-side end is at an advancing side of the opening and closing body when the opening and closing body is in a closing operation. The support member is fixed either to the closing-side end or the facing part. The support member supports the sensor body. The control section controls the drive portion based on a detection result of the object received from the sensor body. The support member includes an attachment main body and a reinforcing member that is embedded in the attachment main body and reinforces the attachment main body. The reinforcing member has a sensor holding portion that is exposed to the outside from the attachment main body and holds the sensor body.

7 Claims, 10 Drawing Sheets

OPENING AND CLOSING APPARATUS

FIELD OF THE INVENTION

The present invention relates to an opening and closing apparatus that opens and closes an opening with an opening and closing body actuated by drive force, for example, from a motor.

BACKGROUND OF THE INVENTION

Conventionally, some vehicles such as automobiles are equipped with a power sliding door apparatus (opening and closing apparatus), which opens and closes a door opening on a side with a door panel (an opening and closing body) slid by drive force, for example, of a motor. Such a power sliding door apparatus has an object detecting device for detecting an object caught between the edge of the door opening and the door panel. An object detecting device disclosed in Japanese Laid-Open Patent Publication No. 2000-292279 includes an elongated cable-like sensor body and an elongated tubular support member. The sensor body has an elongated hollow insulator that is elastically deformable. The hollow insulator has in it a plurality of sensing electrodes, which are connected in series via a resistor. Current is supplied to the sensing electrodes. The support member supports and fixes the sensor body to the front end of the door panel. The support member, which is formed of elastically deformable material, has an insertion hole extending along the longitudinal direction thereof. The support member extends along the front end of the door panel with the sensor body inserted into the insertion hole from one end of the support member in the longitudinal direction. When an object contacts the support member, the sensor body receives a pressing force via the support member, so that the hollow insulator is elastically deformed. Elastic deformation of the hollow insulator causes the sensing electrodes to contact and be short-circuited to each other, so that current supplied to the sensing electrodes flows from an electrode of a higher voltage to the other electrode of a lower voltage without flowing through the resistor. When the current of a constant voltage supplied to the sensing electrodes flows from the sensing electrode of the higher voltage to the sensing electrode of the lower voltage without flowing through the resistor, the current value changes. Therefore, based on the change in the current value, the object contacting the front end of the door panel is detected.

The support member disclosed in the above publication is tubular because of the insertion hole for receiving the sensor body. Since the insertion hole is formed to extend through the support member along the longitudinal direction, the hollow support member is difficult to manufacture and costly. Also, a process for inserting the elongated sensor body into the insertion hole formed in the elongated support member is not easy, and thus increases the manufacturing costs.

SUMMARY OF THE INVENTION

Accordingly, it is an objective of the present invention to provide an opening and closing apparatus that reduces the costs related to fixation of a sensor body to an opening and closing body or to an edge of an opening.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to the drawings.

Figure 1:
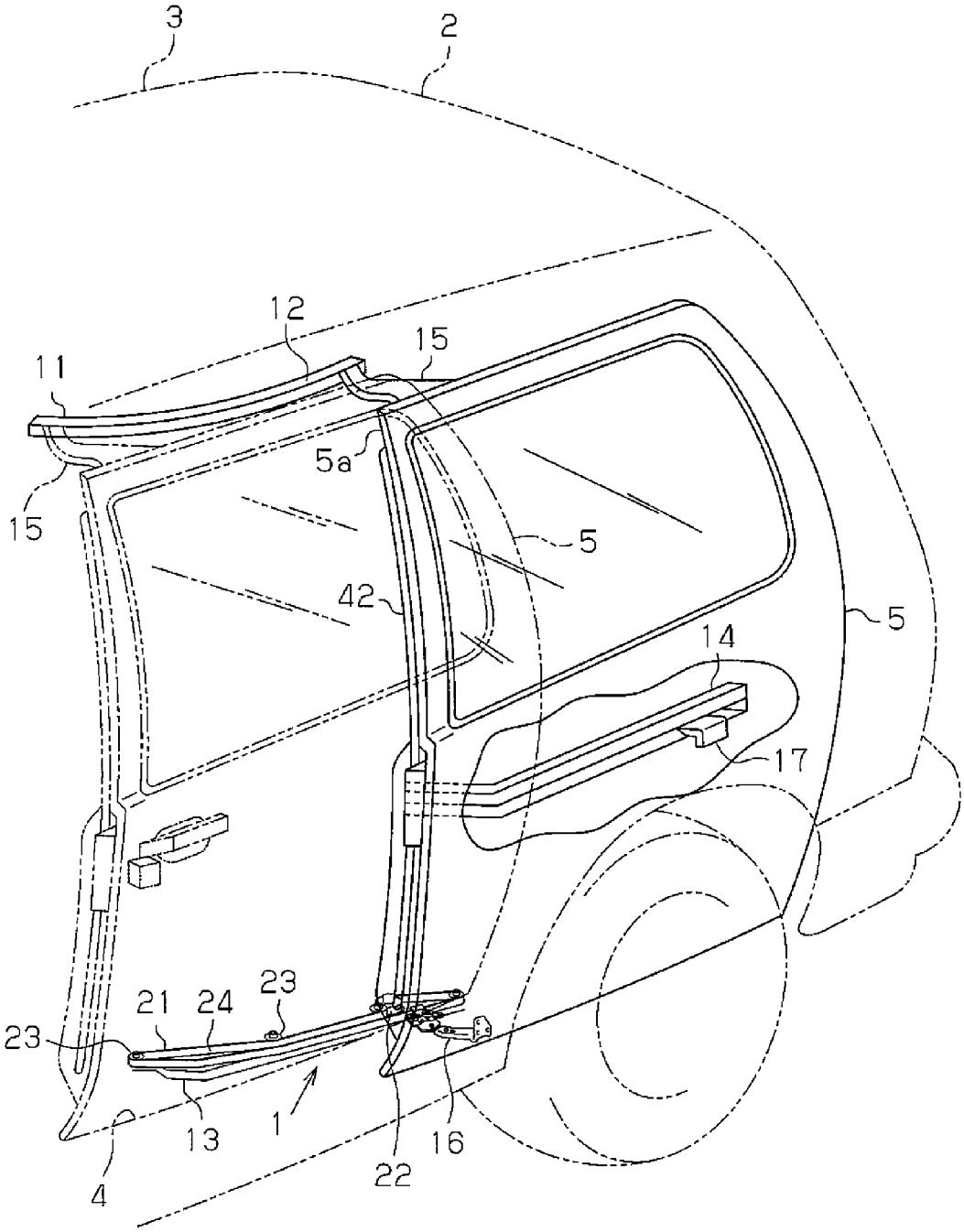
FIG. 1 is a perspective view illustrating a vehicle equipped with a power sliding door apparatus according to a first embodiment of the present invention.
Figure 2:
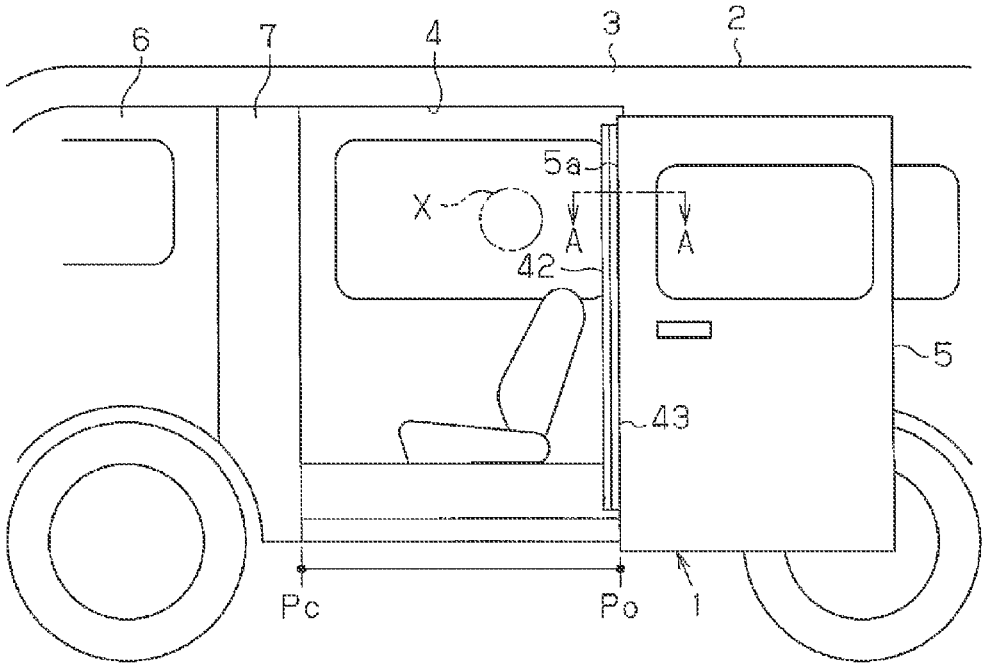
FIG. 2 is a side view showing the vehicle of FIG. 1.

FIG. 1 illustrates a vehicle 2 equipped with an opening and closing apparatus, which is a power sliding door apparatus 1. As shown in FIG. 1, the vehicle 2 includes a vehicle body 3 made of a conductive metal material. A rectangular opening, which is a door opening 4, is formed in the left side of the vehicle body 3. The door opening 4 is opened and closed with a rear door panel 5 (opening and closing body) formed of conductive metal material. The rear door panel 5 has a rectangular shape in accordance with the shape of the door opening 4. As shown in FIG. 2, a conductive front door panel 6 is provided in front of the door opening 4. A vertically extending conductive center pillar 7 is provided between the rear door panel 5 and the front door panel 6 when the door opening 4 is closed.

As shown in FIG. 1, the rear door panel 5 is attached to the vehicle body 3 with an actuating mechanism 11 (drive portion). The rear door panel 5 is movable in the front-rear direction so as to open and close the door opening 4. The actuating mechanism 11 is composed of an upper rail 12, a lower rail 13, and a center rail 14 provided in the vehicle body 3, and an upper arm 15, a lower arm 16, and a center arm 17 provided in the rear door panel 5.

The upper rail 12 and the lower rail 13 are respectively provided in an upper portion and a lower portion of the door opening 4 in the vehicle 2, and extend along the front-rear direction of the vehicle 2. The center rail 14 is provided in centrally in the up-down direction of a portion rearward of the door opening 4 in the vehicle 2, and extends along the front-rear direction of the vehicle 2. Front portions of the rails 12 to 14 are curved toward the passenger compartment.

The arms 15 to 17 are respectively fixed to positions of an upper portion, a lower portion, and a center portion in a side surface facing the interior of the passenger compartment of the rear door panel 5. The upper arm 15 is coupled to the upper rail 12. The lower arm 16 is coupled to the lower rail 13. The center arm 17 is coupled to the center rail 14. The arms 15 to 17 are respectively guided by the rails 12 to 14 so as to be movable along the front-rear direction of the vehicle 2.

Figure 3:
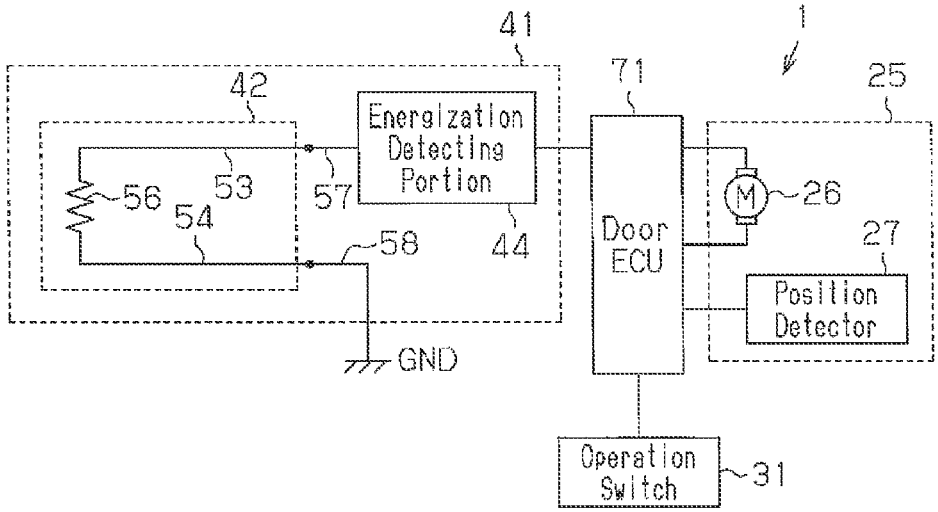
FIG. 3 is an electrical configuration of the power sliding door apparatus of FIG. 1.

The lower arm 16 is moved along the front-rear direction by a drive mechanism 21 (force transmitting portion). More specifically, the drive mechanism 21 includes a drive pulley 22 and driven pulleys 23 at positions closer to the passenger compartment than the lower rail 13. The pulleys 22, 23 are each rotatable about a shaft extending in the up-down direction of the vehicle 2. An endless belt 24 is wound around the drive pulley 22 and the driven pulleys 23. A distal end portion of the lower arm 16 is fixed to the endless belt 24. As shown in FIGS. 1 and 3, the drive mechanism 21 includes a slide actuator 25 connected to the drive pulley 22. The slide actuator 25 is located in the passenger compartment. The slide actuator 25 is provided with a slide motor 26 and a speed reducing mechanism (not shown), which reduces the speed of rotation of the slide motor 26 and transmits the rotation to the drive pulley 22. When the slide motor 26 is driven, the drive pulley 22 is rotated. Then, the endless belt 24 is rotated to move the lower arm 16 in the front-rear direction. The rear door panel 5 is thus slid along the front-rear direction.

A position detector 27 for detecting rotation of the slide motor 26 is arranged in the slide actuator 25. The position detector 27 includes, for example, a permanent magnet (not shown) and a Hall IC (not shown). The permanent magnet rotates integrally with the rotary shaft (not shown) of the slide motor 26 or with the reducing gear (not shown) of the speed reducing mechanism, and the Hall IC is arranged to face the permanent magnet. The Hall IC outputs, as position detection signals, pulse signals in accordance with changes in the magnetic field of the permanent magnet caused by rotation of the permanent magnet.

As shown in FIGS. 2 and 3, the power sliding door apparatus 1 includes an operation switch 31 that commands a door ECU to open or close the rear door panel 5. When an occupant of the vehicle 2 operates the operation switch 31 to open the door opening 4, the operation switch 31 outputs to the door ECU 71 an open signal, which is a command for sliding the rear door panel 5 to open the door opening 4. In contrast, when the occupant of the vehicle 2 operates the operation switch 31 to close the door opening 4, the operation switch 31 outputs to the door ECU 71 a close signal, which is a command for sliding the rear door panel 5 to close the door opening 4. The operation switch 31 is provided, for example, in a predetermined portion (for example, in the dashboard) within the passenger compartment, on the door lever (not shown) of the rear door panel 5, or in a portable item (not shown) carried together with the ignition key.

The power sliding door apparatus 1 has an object detecting device 41 for detecting an object X that is located between a front end 5*a* (closing edge) of the rear door panel 5 and an edge of the door opening 4. The object detecting device 41 includes a sensor body 42, a support member 43, and an energization detecting portion 44.

Figure 4A:
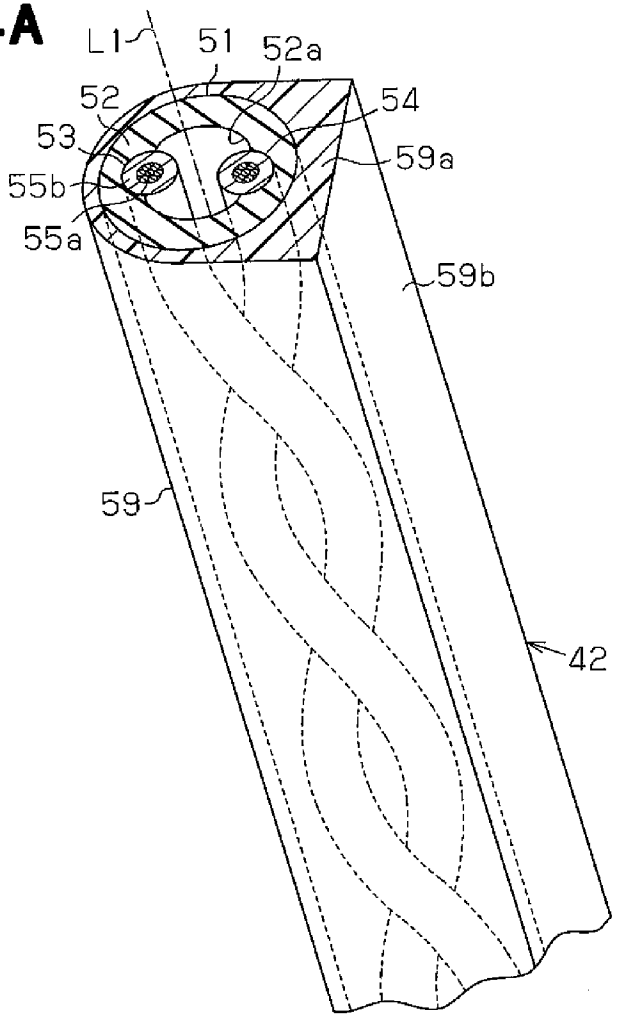
FIG. 4A is a cross-sectional perspective view of a sensor body in the power sliding door apparatus taken along line A-A of FIG. 2.

FIG. 4A is a perspective view of the sensor body 42. As shown in FIG. 4A, the sensor body 42 has an elongated cable-like sensor line 51. As shown in FIG. 2, the length of the sensor line 51 is substantially equal to the length in the up-down direction of the front end 5*a* of the rear door panel 5.

The sensor line 51 has a hollow insulator 52. The hollow insulator 52 is formed by an elastically deformable insulator having insulating and shape-restoring properties (soft resin material or rubber). The hollow insulator 52 is substantially cylindrical. A separation hole 52*a* is formed in a radial center portion of the hollow insulator 52. The separation hole 52*a* extends in the longitudinal direction of the hollow insulator 52. The separation hole 52*a* is a through hole extending along the longitudinal direction of the hollow insulator 52.

A pair of sensing electrodes 53, 54 are arranged inside and held by the hollow insulator 52. The sensing electrodes 53, 54 each include a flexible core electrode 55*a* and a cylindrical conductive coating layer 55*b*. The core electrode 55*a* is formed by twining conductive fine lines, and coated by the conductive coating layer 55*b*. The conductive coating layer 55*b* has conductivity and elasticity. The two sensing electrodes 53, 54 are arranged in the hollow insulator 52 to be separated from each other, and extend helically along the longitudinal direction of the hollow insulator 52. In the present embodiment, the pair of sensing electrodes 53, 54 face each other along the direction of the diameter of the hollow insulator 52 at any position in the longitudinal direction of the hollow insulator 52. Approximately half the circumference of each of the sensing electrodes 53, 54 is embedded in the hollow insulator 52.

As shown in FIG. 3, a first end of the sensing electrode 53 and a first end of the sensing electrode 54, which are drawn out of a first end of the hollow insulator 52 in the longitudinal direction, are connected to each other via a resistor 56 (a diagnostic resistor). A second end of the sensing electrode 53 and a second end of the sensing electrode 54, which are drawn out of a second end of the hollow insulator 52 in the longitudinal direction, are connected to feeder cables 57, 58 for supplying electricity to the sensor line 51, respectively. The feeder cables 57, 58 are drawn into the rear door panel 5. The feeder cable 57, which is connected to the sensing electrode 53, is electrically connected to the energization detecting portion 44. The feeder cable 58, which is connected to the sensing electrode 54, is connected to the ground GND.

As shown in FIG. 4A, the outer circumference of the hollow insulator 52 is coated with an elastic insulating member 59 having elastic and insulative properties. The elastic insulating member 59 is formed integrally on the outer circumference of the hollow insulator 52 without any clearance. The elastic insulating member 59 is formed of urethane resin. The elastic insulating member 59 is substantially cylindrical. A fixing portion 59*a* is formed on a part of the circumference of the elastic insulating member 59. The fixing portion 59*a* is formed by partly increasing the radial thickness of the elastic insulating member 59 so that the member 59 projects radially outward of the sensor line 51. The fixing portion 59*a* is formed to extend from one end to the other end in the longitudinal direction of the elastic insulating member 59. The fixing portion 59*a* has a fixing surface 59*b* serving as a held portion. The fixing surface 59*b* is located at the distal end of the fixing portion 59*a* projecting from the sensor line 51 (at the side opposite to the sensor line 51). The fixing surface 59*b* extends from the first end to the second end in the longitudinal direction of the elastic insulating member 59, and is parallel to the center line L1 of the hollow insulator 52. That is, the distance between the center line L1 and the fixing surface 59*b* is constant at any position along the longitudinal direction of the elastic insulating member 59. The elastic insulating member 59 is formed by the extrusion.

Figure 5:
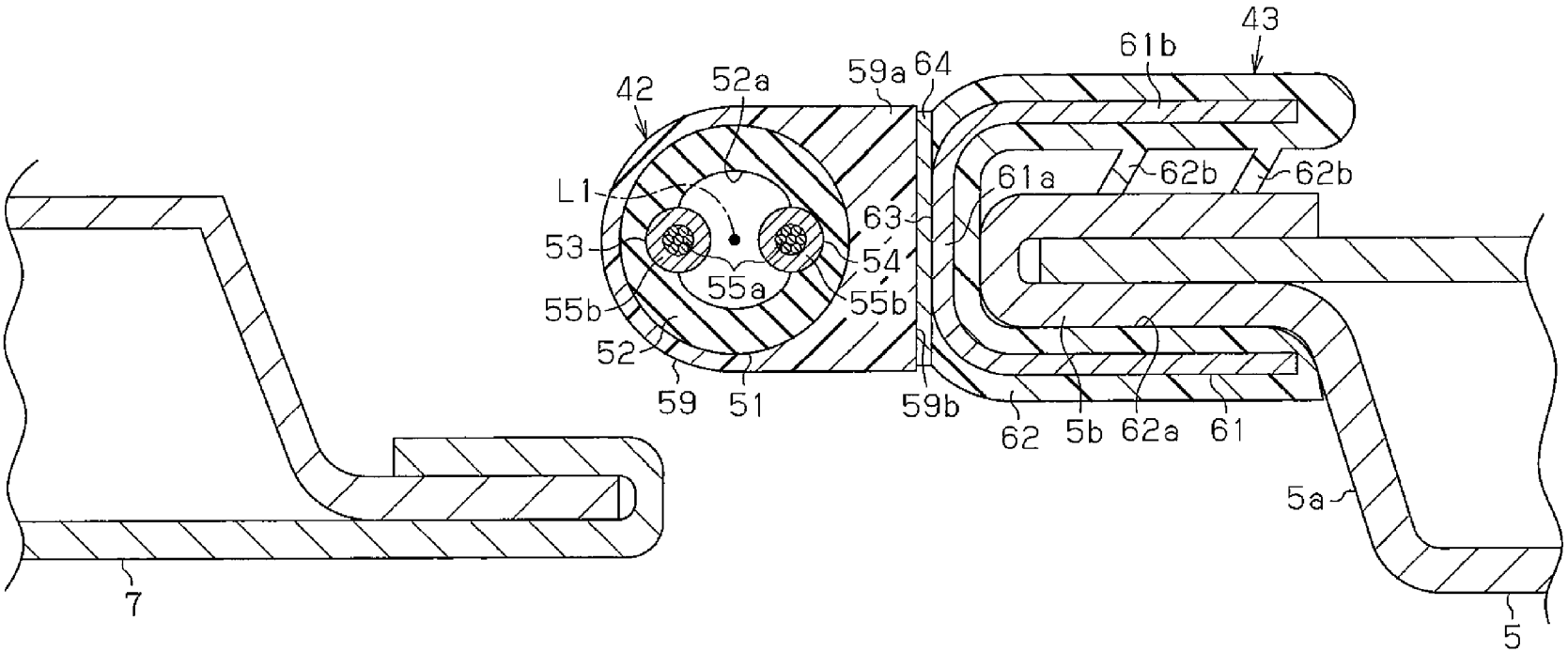
FIG. 5 is a cross-sectional view taken along line A-A of FIG. 2 and illustrating the front end of a door panel according to the first embodiment of the present invention.

As shown in FIG. 5, the support member 43 supports the sensor body 42 by fixing it to the front end 5*a* of the rear door panel 5. The support member 43 includes a reinforcing member 61 made of a metal plate and an attachment main body 62 in which the reinforcing member 61 is embedded.

Figure 6:
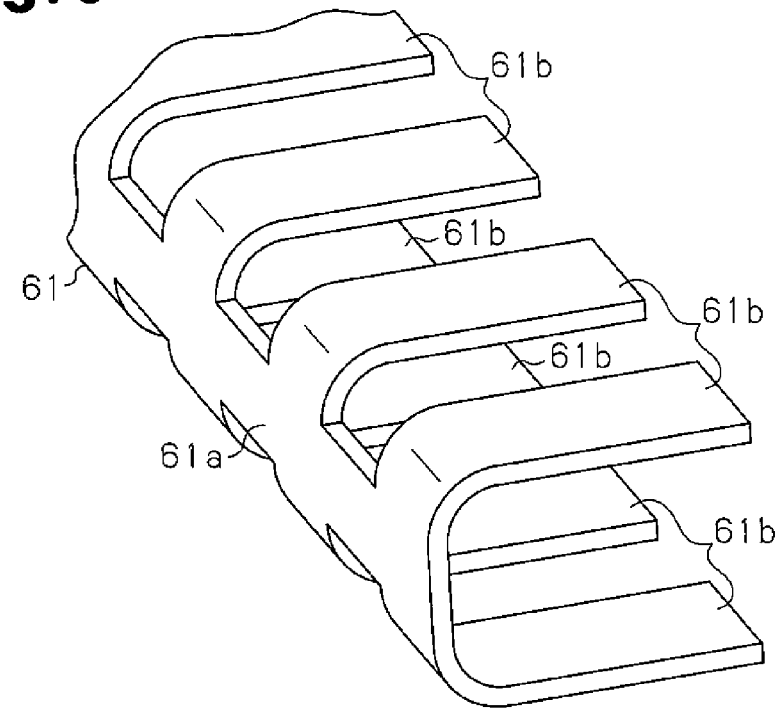
FIG. 6 is a perspective view illustrating a reinforcing member according to the first embodiment of the present invention.

As shown in FIGS. 5 and 6, the reinforcing member 61 includes a belt-like reinforcing core 61*a* and a plurality of reinforcing extensions 61*b*, which are arranged along the longitudinal direction of the reinforcing core 61*a*. The reinforcing core 61*a* is shaped like an elongated belt. The length of the reinforcing core 61*a* in the longitudinal direction is substantially equal to the length of the sensor line 51 in the longitudinal direction. The width (the length in the transverse direction) of the reinforcing core 61*a* is slightly less than the outer diameter of the sensor line 51. The reinforcing extensions 61*b* extend from both of the widthwise sides of the reinforcing core 61*a*. The reinforcing extensions 61*b* are formed at equal intervals along the longitudinal direction of the reinforcing core 61*a*. The reinforcing extensions 61*b* are bent or curved relative to the reinforcing core 61*a*. The reinforcing extensions 61*b* are bent at proximal portions such that the distal ends of the reinforcing extensions 61*b* on one side in the widthwise direction of the reinforcing core 61*a* and the ends of the reinforcing extensions 61*b* on the other side approach each other. Since the reinforcing extensions 61*b* are bent at proximal portions substantially by a right angle relative to the reinforcing core 61*a*, the reinforcing member 61 is shaped like a channel when viewed in the longitudinal direction.

As shown in FIG. 5, the attachment main body 62 is formed of an elastic insulating resin material (including rubber and elastomer). The attachment main body 62 has an attaching groove 62*a* between the reinforcing extensions 61*b* facing each other with the reinforcing core 61*a* in between. The attaching groove 62*a* opens at the side opposite to the reinforcing core 61*a*. The attaching groove 62*a* extends along the longitudinal direction of the elastic insulating member 59 from one end to the other end of the attachment main body 62. Two pressing protrusions 62*b* are formed on one of the facing inner sides of the attaching groove 62*a*. The pressing protrusions 62*b* project from one of the two facing inner surfaces that define the attaching groove 62*a* toward the other inner surface.

The attachment main body 62 is formed such that, of both end faces of the reinforcing core 61*a* in the direction of thickness, the end face opposite to the reinforcing extensions 61*b* (that is, the surface opposite to the attaching groove 62*a*) is exposed to the outside. This end face of the reinforcing core 61*a*, which is exposed from the attachment main body 62, serves as an exposed holding portion 63, which serves as a sensor holding portion.

A double-faced adhesive tape 64 is provided between the fixing surface 59*b* of the elastic insulating member 59 and the exposed holding portion 63 of the reinforcing member 61. The adhesive tape 64 fixes the sensor body 42 to the support member 43. The support member 43, which holds the sensor body 42, is fixed to an attachment bracket 5*b* formed at the front end 5*a* of the rear door panel 5. The attachment bracket 5*b* is shaped like a plate and projects toward the front of the vehicle 2 from the front end 5*a* of the rear door panel 5. The attachment bracket 5*b* ranges between the upper end and the lower end of the rear door panel 5 at the front end 5*a* of the rear door panel 5. The direction of the thickness of the attachment bracket 5*b* matches with the widthwise direction of the vehicle 2. The support member 43, which holds the sensor body 42, is fixed to the front end 5*a* of the rear door panel 5 by press fitting the attaching bracket 5*b* into the attaching groove 62*a* of the attachment main body 62. The support member 43 thus supports the sensor body 42 by fixing it to the front end 5*a* of the rear door panel 5. The pressing protrusions 62*b* formed on the inner surface of the attaching groove 62*a* press the attachment bracket 5*b* in the groove 62*a* along the direction of the thickness, thereby preventing the support member 43 from falling off the attachment bracket 5*b*.

Figure 4B:
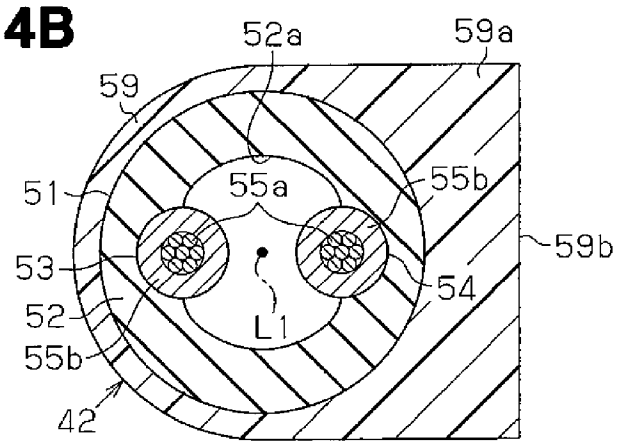
FIG. 4B is a cross-sectional view of the sensor body of FIG. 4A.
Figure 4C:
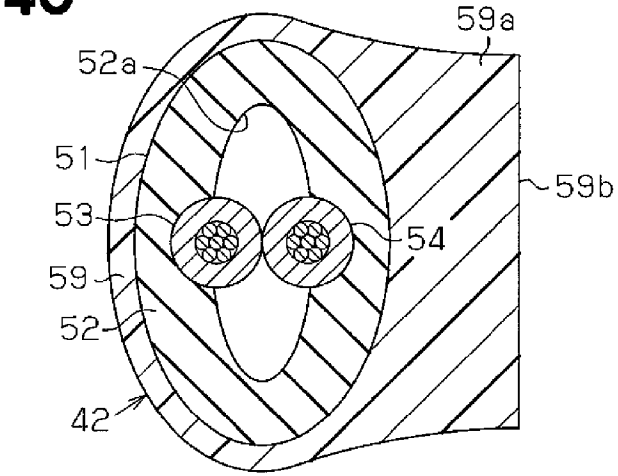
FIG. 4C is a cross-sectional view illustrating the sensor body of FIG. 4B when receiving a pressing force.

As shown in FIG. 3, the energization detecting portion 44 is electrically connected to the sensing electrode 42. The energization detecting portion 44 supplies electric current to the sensing electrode 53 through the feeder cable 57. When no pressing force is applied to the sensor body 42 as shown in FIGS. 3 and 4B, the current supplied from the energization detecting portion 44 to the sensing electrode 53 flows to the sensing electrode 54 through the resistor 56. In contrast, when a pressing force acts on the sensor body 42 in a crushing manner in a direction along the diameter as shown in FIGS. 3 and 4C, the elastic insulating member 59 and the hollow insulator 52 are elastically deformed in an integral manner. As a result, the sensing electrodes 53 and the sensing electrodes 54 contact each other and are electrically connected to one another. The current supplied from the energization detecting portion 44 to the sensing electrode 53 flows to the sensing electrode 53 without flowing through the resistor 56. Thus, for example, in a case where a current is supplied at a constant voltage to the sensing electrode 53, the current value through the sensing electrode 53, 54 when no pressing force is applied to the sensor body 42 is different from the current value through the sensing electrodes 53, 54 when a pressing force is applied to the sensor body 42. The energization detecting portion 44 detects such a change in the current value, thereby detecting whether a pressing force is applied to the sensor body 42. When detecting a change in the current value, the energization detecting portion 44 outputs a contact detection signal to a door ECU 71 discussed below. When pressing force acting on the sensor body 42 is removed, the elastic insulating member 59 and the hollow insulator 52 restore to their original shapes, so that the sensing electrodes 53, 54 restore to their original shapes and are electrically disconnected from each other.

As shown in FIG. 3, the power sliding door apparatus 1 according to the present embodiment is controlled by the door ECU 71, which functions as a control section. The door ECU 71 functions as a microcomputer that includes a ROM (Read Only Memory) and a RAM (Random Access Memory). The door ECU 71 is located, for example, in the vicinity of the slide door actuator 25, and supplied with electricity from the battery (not shown) of the vehicle 2. Based on various signals sent from the operation switch 31, the position detector 27, and the energization detecting portion 44, the door ECU 71 controls the slide door actuator 25.

The operation of the power sliding door apparatus 1 will now be described.

When receiving an open signal from the operation switch 31, the door ECU 71 outputs a drive signal to the slide actuator 25 to open the rear door panel 5. Based on a position detection signal sent from the position detector 27, the door ECU 71 monitors the position of the rear door panel 5. In the present embodiment, the door ECU 71 counts the number of pulses of the position detection signal, and monitors the position of the rear door panel 5 based on the count value. When the rear door panel 5 is at a full open position Po, where it fully opens the door opening 4 (see FIG. 2), the door ECU 71 stops the slide actuator 25.

When receiving a close signal from the operation switch 31, the door ECU 71 outputs a drive signal to the slide actuator 25 to close the rear door panel 5. When the rear door panel 5 is at a full close position Pc, where it fully closes the door opening 4 (see FIG. 2), the door ECU 71 stops the slide actuator 25. If an object X contacts the sensor body 42 and applies pressing force to the sensor body 42 while the rear door panel 5 is being closed, the elastic insulation member 59 and the hollow insulator 52 are elastically deformed so that the pair of sensing electrodes 53, 54 contact each other and are electrically connected to each other. As a result, the value of the current supplied to the sensing electrode 53 changes and the energization detecting portion 44 outputs a contact detection signal to the door ECU 71. When receiving the contact detection signal, the door ECU 71 reverses the slide actuator 25, thereby closing the rear door panel 5 by a predetermined amount and then stops the slide actuator 25.

As described above, the first embodiment provides the following advantages.

(1) The exposed holding portion 63 is a part of the reinforcing member 61, which reinforces the attachment main body 62, that is, a part of the reinforcing core 61*a* that is exposed to the outside of the attachment main body 62. Therefore, the sensor body 42 is directly held by the reinforcing member 61, which reinforces the attachment main body 62. The sensor body 42 is thus stably held by the front end 5*a* of the rear door panel 5 with the support member 43. Since the exposed holding portion 63 is a part of the reinforcing member 61 (that is, the reinforcing core 61*a*), which is exposed through the attachment main body 62, no insertion hole for inserting a sensor body needs to be formed in a support member like the prior art. This reduces the manufacturing costs of the support member 43. Specifically, it is possible to reduce the costs for fixing the sensor body 42 to the front end 5*a* of the rear door panel 5.

(2) Since the exposed holding portion 63 is the elongated reinforcing core 61*a*, which is exposed to the outside from the attachment main body 62, it is possible to hold the elongated sensor body 42 in a wide range along the longitudinal direction of the sensor body 42. Therefore, the sensor body 42 is further stably held by the exposed holding portion 63.

(3) Since the elastic insulating member 59 is formed integrally with the outer circumference of the sensor line 51, the elastic insulating member 59 protects the sensor line 51. According to the prior art support member, the sensor body is inserted into the insertion hole. In this case, to allow the insertion of the sensor body into the insertion hole, a clearance needs to be created between the sensor body and the inner circumferential surface of the insertion hole. From when an object contacts the support member to when the sensing electrodes are short-circuited, the object deforms the support member and the sensor body by a relatively large amount. This can lower the sensitivity for detecting objects and increase the load applied to the support member and the sensor body by an object until the sensing electrodes are short-circuited. In contrast, according to the present embodiment, since no clearance exists between the outer circumferential surface of the sensor line 51 and the elastic insulating member 59, pressing force applied to the sensor body 42 allows the elastic insulating member 59 and the hollow insulator 52 to be elastically deformed in an integral manner. Therefore, the sensor body 42 responds sensitively to pressing force applied by an object X, so as to sensitively detect an object X contacting the sensor body 42.

(4) Since the elastic insulating member 59 is formed of urethane resin, the elastic insulating member 59 prevents oil from entering the sensor body 42. Also since urethane resin has a superior weather resistance, the elastic insulating member 59 can protect the sensing electrodes 53, 54 for an extended period of time.

(5) The sensor body 42 is easily fixed to the exposed holding portion 63 by means of the double-faced adhesive tape 64. Thus, unlike the prior art, no complicated operations, such as insertion of a sensor body into an insertion hole of a support member, are required. Therefore, costs for fixing the sensor body 42 to the front end 5*a* of the rear door panel 5 is further reduced. Also, it is possible to fix the sensor body 42 to the exposed holding portion 63 in a short time.

(6) Since the elastic insulating member 59 is formed by the extrusion, an extrusion die corresponding to the shape of the elastic insulating member 59 can be used, so that the elastic insulating member 59 can be easily manufactured at lower cost.

A second embodiment of the present invention will now be described with reference to the drawings. In the present embodiment, the same reference numerals are given to those components that are the same as the corresponding components of the first embodiment, and detailed explanations are omitted.

Figure 8:
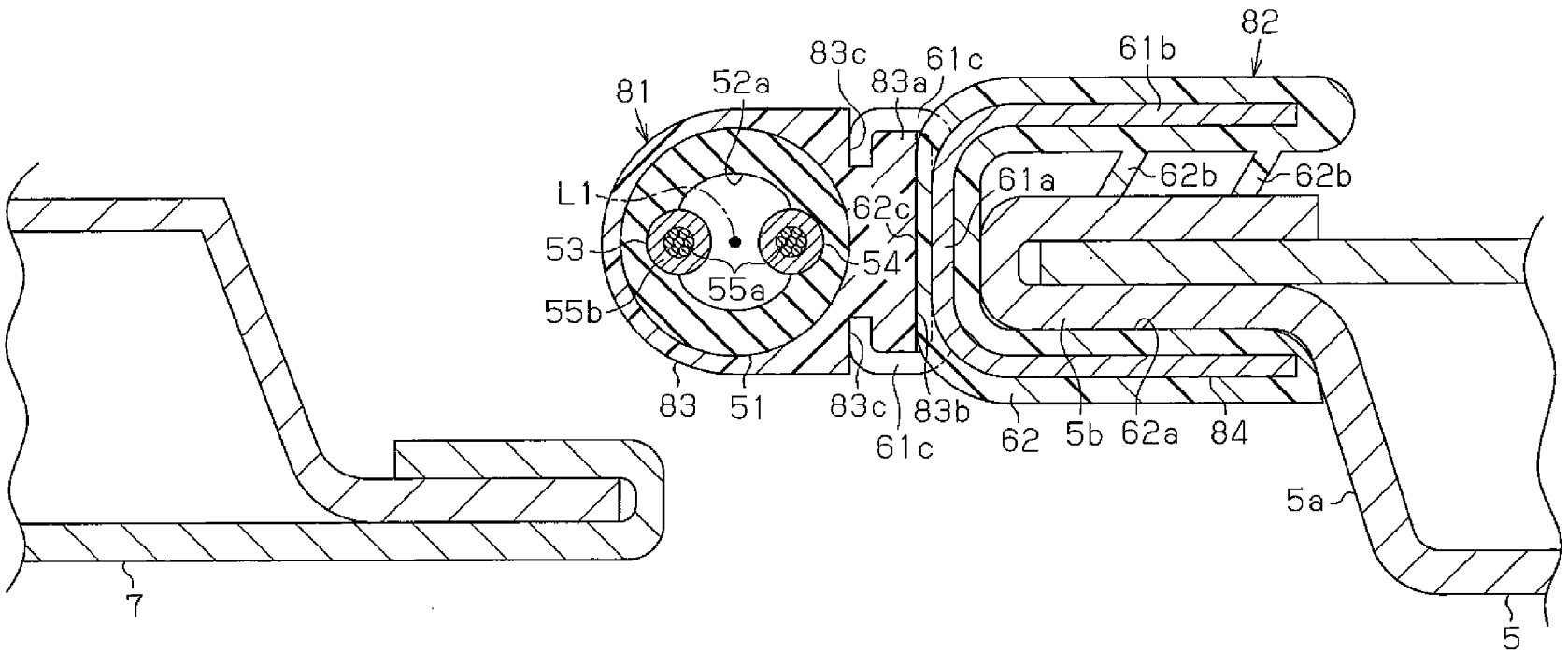
FIG. 8 is a cross-sectional view taken along line A-A of FIG. 2 and illustrating the front end of a door panel according to the second embodiment of the present invention.

A sensor body 81 and a support member 82 shown in FIG. 8 are used in the object detecting device 41 of the power sliding door apparatus 1, instead of the sensor body 42 and the support member 43 of the first embodiment.

The sensor body 81 has a sensor line 51 and an elastic insulating member 83 coating the outer circumference of the sensor line 51. The elastic insulating member 83 is formed of urethane resin having elasticity and insulating properties. The elastic insulating member 83 is formed integrally on the outer circumference of the hollow insulator 52 of the sensor line 51 without any clearance. The elastic insulating member 83 is substantially cylindrical. A fixing portion 83*a* is formed on a part of the circumference of the elastic insulating member 83. The fixing portion 83*a* is formed by partly increasing the radial thickness of the elastic insulating member 83 so that the member 83 projects radially of the sensor line 51. The fixing portion 83*a* is formed to extend from one end to the other end in the longitudinal direction of the elastic insulating member 83. A contact surface 83*b* is formed at the distal end of the fixing portion 83*a* in the projecting direction of the fixing portion 83*a* relative to the sensor line 51 (that is, the side opposite to the sensor line 51). The contact surface 83*b* is parallel to the center line L1 of the hollow insulator 52 (that is, the distance from the center line L1 is constant at any position in the longitudinal direction). The fixing portion 83*a* also has holding grooves 83*c* formed on the sides in the widthwise direction (the same direction as the widthwise direction of the contact surface 83*b*, the up-down direction in FIG. 8). The holding grooves 83*c*, which serve as held portions, extend along the longitudinal direction of the elastic insulating member 83 at positions on the sides of the fixing portion 83*a* in the widthwise direction. The cross section of the pair of holding grooves 83*c* perpendicular to the longitudinal direction of the elastic insulating member 83 is substantially rectangular. The elastic insulating member 83 is formed by the extrusion.

Figure 7:
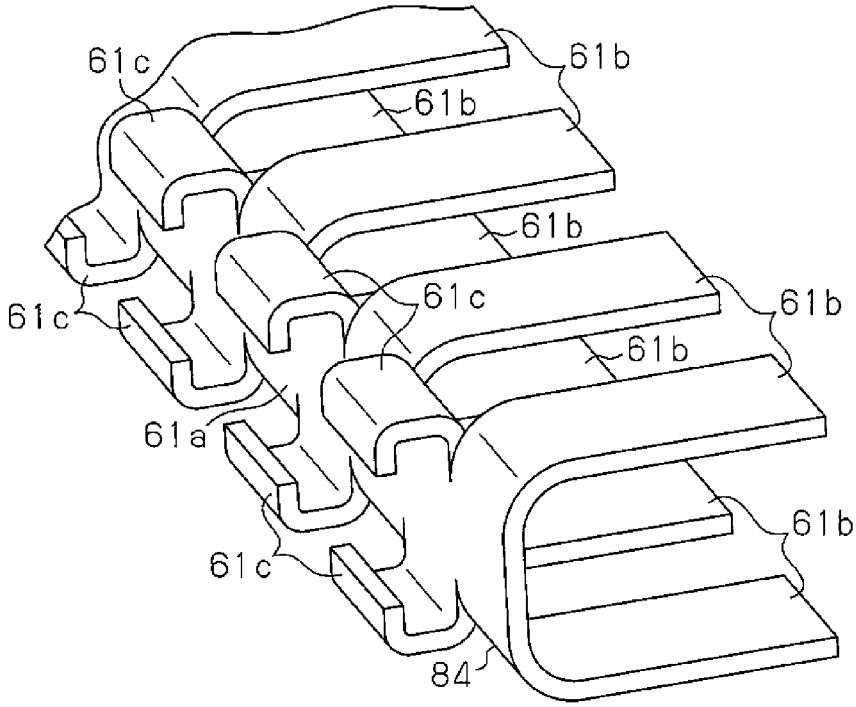
FIG. 7 is a perspective view illustrating a reinforcing member according to a second embodiment of the present invention.

The support member 82 includes a reinforcing member 84 made of a metal plate and an attachment main body 62 in which the reinforcing member 84 is embedded. As shown in FIG. 7, the reinforcing member 84 includes a belt-like reinforcing core 61*a*, a plurality of reinforcing extensions 61*b*, which are arranged along the longitudinal direction of the reinforcing core 61*a*, and a plurality of holding claws 61*c*, which are arranged along the longitudinal direction of the reinforcing core 61*a*. The holding claws 61*c* extend from both of the widthwise sides of the reinforcing core 61*a*. Each holding claw 61*c* is located between a pair of the reinforcing extensions 61*b* adjacent to each other in the longitudinal direction of the reinforcing core 61*a*. That is, the holding claws 61*c* and the reinforcing extensions 61*b* are formed alternately along the longitudinal direction of the reinforcing core 61*a*. The holding claws 61*c* are bent at proximal portions and distal portions such that the distal ends of the holding claws 61*c* on one side in the widthwise direction of the reinforcing core 61*a* and the ends of the holding claws 61*c* on the other side approach each other. The holding claws 61*c*, which are bent in the above described manner, have a channel-like shape when viewed in the longitudinal direction. The holding claws 61*c* on one side in the widthwise direction of the reinforcing core 61*a* and the holding claws 61*c* on the other side face each, so as to open toward each other.

As shown in FIG. 8, the attachment main body 62 incorporates the reinforcing core 61*a* and the reinforcing extensions 61*b* of the reinforcing member 84, while exposing the holding claws 61*c* to the outside. That is, the holding claws 61*c* protrudes to the outside from the attachment main body 62. A holding surface 62*c* is formed in the attachment main body 62 at a position between the facing the holding claws 61*c*. The holding surface 62*c* is flat and parallel to the reinforcing core 61*a*.

The holding claws 61*c* of the support member 82 are sequentially inserted into the pair of holding grooves 83*c* from one end in the longitudinal direction, so that the sensor body 81 is assembled to and held by the support member 82. The outer surfaces of the holding claws 61*c* inserted in the holding grooves 83*c* contact the inner surfaces of the holding grooves 83*c*, so that the holding claws 61*c* are engaged with the holding grooves 83*c*. Also, the contact surface 83*b* of the elastic insulating member 83 and the holding surface 62*c* of the attachment main body 62 contact each other to prevent the sensor body 81 from chattering relative to the support member 82. The support member 82, which holds the sensor body 81, is fixed to the front end 5*a* of the rear door panel 5 by press fitting the attaching bracket 5*b* into the attaching groove 62*a* of the attachment main body 62. The support member 82 thus supports the sensor body 81 by fixing it to the front end 5*a* of the rear door panel 5.

In addition to the advantages (1), (3), (4) and (6) of the first embodiment, the present embodiment has the following advantages.

(7) The holding claws 61*c* extending from the reinforcing core 61*a* are engaged with the holding grooves 83*c* formed in the sensor body 81, so that the sensor body 81 is easily held by the support member 82 with the holding claws 61*c*.

(8) The reinforcing extensions 61*b* and the holding claws 61*c* are formed alternately along the longitudinal direction of the reinforcing core 61*a*. This allows the elongated sensor body 81 to be held by the holding claws 61*c* at a number of positions along the longitudinal direction. Also, the holding claws 61*c* extend from both sides in the widthwise direction of the reinforcing core 61*a*, so as to hold the sensor body 42 from both sides in the widthwise direction of the reinforcing core 61*a*. Therefore, the support member 43 more stably holds the sensor body 42.

A third embodiment of the present invention will now be described with reference to the drawings. In the present embodiment, the same reference numerals are given to those components that are the same as the corresponding components of the first embodiment, and detailed explanations are omitted.

Figure 9:
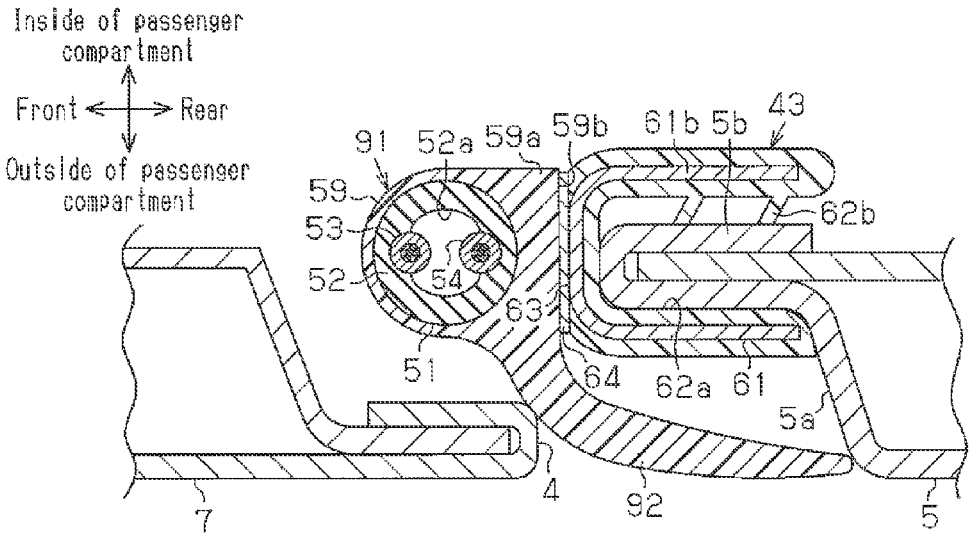
FIG. 9 is a cross-sectional view taken along line A-A of FIG. 2 and illustrating the front end of a door panel according to a third embodiment of the present invention.

A sensor body 91 shown in FIG. 9 is used in the object detecting device 41 of the power sliding door apparatus 1, instead of the sensor body 42 of the first embodiment. The sensor body 91 has a sensor line 51, an elastic insulating member 59 coating the outer circumference of the sensor line 51, and a wind roar preventing portion 92 integrally formed with the elastic insulating member 59.

A double-faced adhesive tape 64 is provided between the fixing surface 59*b* of the elastic insulating member 59 and the exposed holding portion 63 of the reinforcing member 61. The adhesive tape 64 fixes the sensor body 91 to the exposed holding portion 63. The support member 43, which holds the sensor body 91, is fixed to the front end 5*a* of the rear door panel 5 by press fitting the attaching bracket 5*b* into the attaching groove 62*a* of the attachment main body 62. Accordingly, the support member 43 supports the sensor body 91 by fixing it to the front end 5*a* of the rear door panel 5.

When the rear door panel 5 closes the door opening 4 (that is, when the rear door panel 5 is at the fully closed position Pc as shown in FIG. 9), wind flowing along the side of the rear door panel 5 generates wind roar. The wind roar preventing portion 92 is designed to reduce such noise, i.e., wind roar. The wind roar preventing portion 92 extends toward the outside of the passenger compartment from the fixing portion 59*a* of the elastic insulating member 59. Specifically, the wind roar preventing portion 92 extends from a vehicle outer side of the fixing portion 59*a* toward the front end 5*a* of the rear door panel 5, so that the distal end is directed to the front end 5*a* of the rear door panel 5. Also, the wind roar preventing portion 92 is slightly inclined outward of the passenger compartment from the proximal end to the distal end. Further, the wind roar preventing portion 92 ranges between one end in the longitudinal direction of the elastic insulating member 59 and the other end. When the rear door panel 5 closes the door opening 4, the wind roar preventing portion 92 is located between the rear door panel 5 and the center pillar 7 with the surface facing away from the passenger compartment being substantially flush with the outer surface of the rear door panel 5 and the outer surface of the center pillar 7. The wind roar preventing portion 92 is formed by the extrusion simultaneously with the elastic insulating member 59.

Figure 10A:
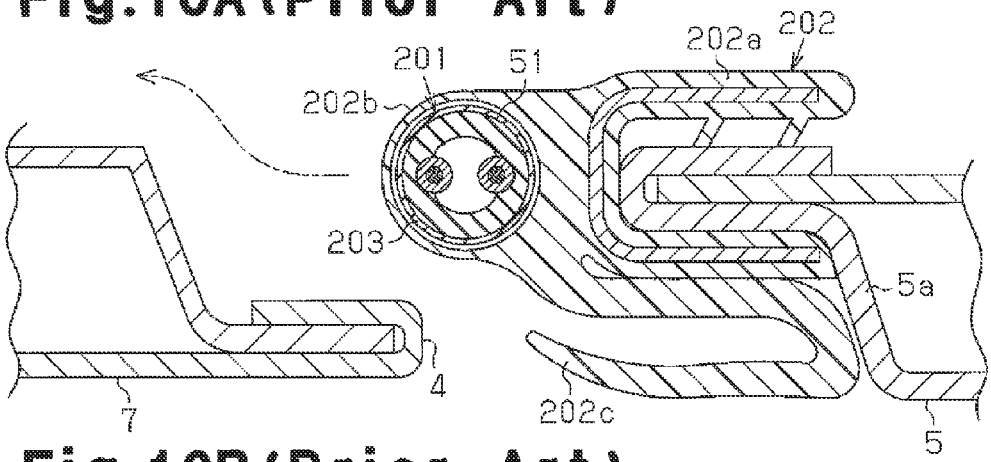
Fig.10A (Prior Art)
FIG. 10A is a cross-sectional view taken along line A-A of FIG. 2 and illustrating the front end of a door panel to which a support member is attached, the support member having a prior art wind roar preventing portion.

FIG. 10A illustrates a prior art sensor body 201 and a support member 202. In the sensor body 201, a sensor line 51 is coated with an outer cover 203 having an insulating property and elasticity. The support member 202 has an attachment portion 202*a* fixed to the attachment bracket 5*b*, a hollow holding portion 202*b* holding the sensor body 201, and a wind roar preventing portion 202*c*. The sensor body 201 is inserted into the holding portion 202*b*, so as to be held by the holding portion 202*b*. The wind roar preventing portion 202*c* is formed integrally with the attachment portion 202*a* and the holding portion 202*b* at the boundary thereof. The wind roar preventing portion 202*c* extends from the boundary between the attachment portion 202*a* and the holding portion 202*b*, along the surface of the attachment portion 202*a* that faces away from the passenger compartment, and toward the front end 5*a* of the rear door panel 5. The wind roar preventing portion 202*c* is then bent at the front end 5*a* and extends toward the center pillar 7. The outer part of the wind roar preventing portion 202*c* has a substantially U-shaped cross section. That is, the distal end of the wind roar preventing portion 202*c* is directed toward the center pillar 7. Also, the wind roar preventing portion 202*c* ranges between one end and the other end in the longitudinal direction of the support member 202. The outer surface of the wind roar preventing portion 202*c* is substantially flush with the outer surface of the rear door panel 5.

Figure 10B:
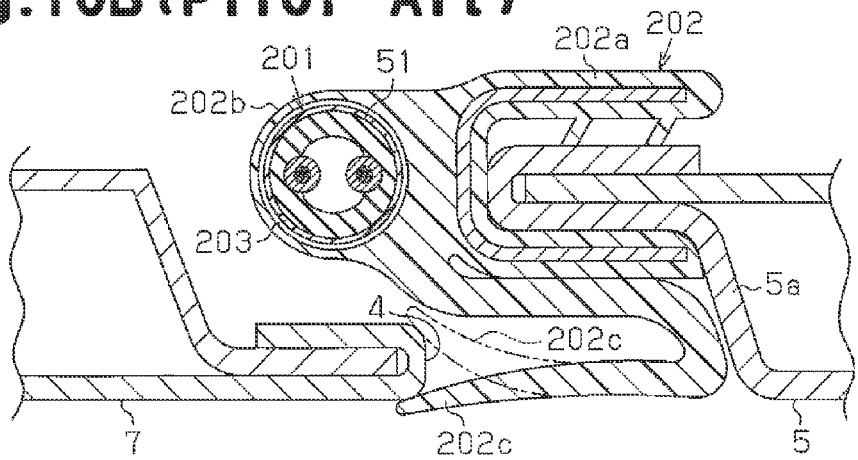
Fig.10B (Prior Art)
FIG. 10B is a cross-sectional view illustrating the front end of the door panel in a state where the vehicle center pillar contacts the distal end of the wind roar preventing portion of FIG. 10A.

The distal end of the prior art wind roar preventing portion 202*c* shown in FIG. 10A is directed toward the center pillar 7. Therefore, in a case where the rear door panel 5 is closed as indicated by the arrow of the dashed line in FIG. 10A, the distal end of the wind roar preventing portion 202*c* contacts the center pillar 7 when the rear door panel 5 is fully closed. Then, as shown in FIG. 10B, when the rear door panel 5 is fully closed (that is, when the door opening 4 is closed), the wind roar preventing portion 202*c* can protrude outward of the passenger compartment. The wind roar preventing portion 202*c* protruding outward of the passenger compartment degrades the appearance. In FIG. 10B, the alternate long and two short dashes line illustrates a state where the door panel 5 is fully closed without causing the wind roar preventing portion 202*c* to protrude outward.

In contrast, since the distal end of the wind roar preventing portion 92 of the present embodiment is directed toward the front end 5*a* of the rear door panel 5, the wind roar preventing portion 92 does not contact the center pillar 7 when the rear door panel 5 is fully closed. It is therefore possible to maintain a favorable appearance when the rear door panel 5 closes the door opening 4.

As described above, the present embodiment has the following advantages in addition to the advantages (1) to (6) of the first embodiment.

(9) Since the wind roar preventing portion 92 for preventing wind roar is formed integrally with the elastic insulating member 59, no additional member for preventing wind roar is needed.

(10) The distal end of the wind roar preventing portion 92 is directed toward the front end 5*a* of the rear door panel 5. Thus, when the rear door panel 5 closes the door opening 4, the distal end of the wind roar preventing portion 92 does not contact the center pillar 7. The wind roar preventing portion 92 therefore does not protrude outward of the passenger compartment between through the rear door panel 5 and the center pillar 7. It is therefore possible to maintain a favorable appearance when the rear door panel 5 closes the door opening 4.

The preferred embodiments of the present invention may be modified as follows.

Figure 11:
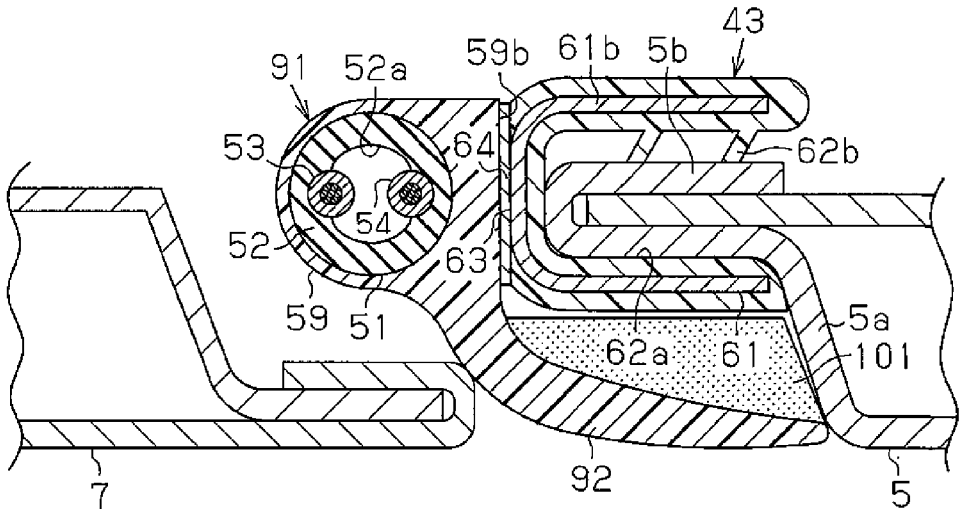
FIG. 11 is a cross-sectional view taken along line A-A of FIG. 2 and illustrating a front end of a door panel to which a support member is attached, the support member having a wind roar preventing portion according to another embodiment.
Figure 12:
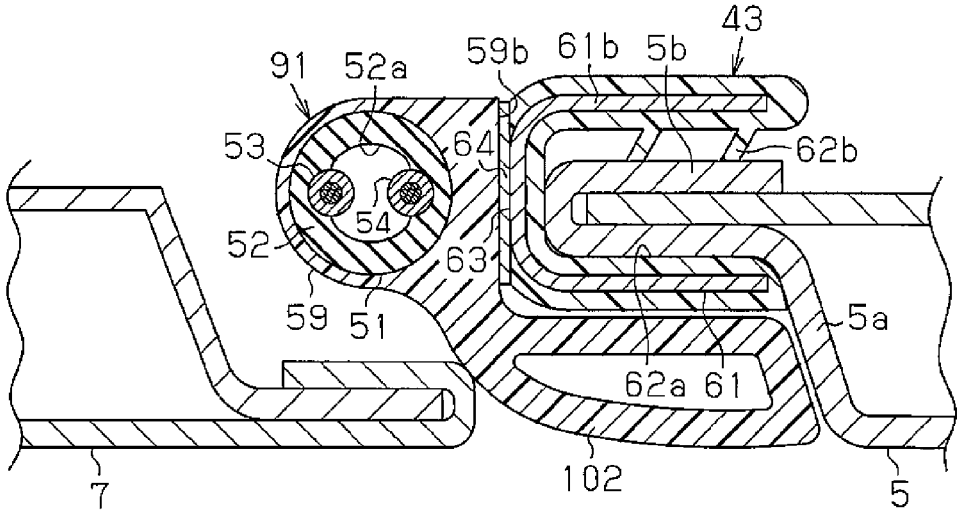
FIG. 12 is a cross-sectional view taken along line A-A of FIG. 2 and illustrating a front end of a door panel to which a support member is attached, the support member having a wind roar preventing portion according to another embodiment.

As shown in FIG. 11, a reinforcing sponge 101 may be fixed to the inner surface of the wind roar preventing portion 92 of the third embodiment. The sponge 101 has a shape for filling the space between the wind roar preventing portion 92 and the support member 43. In this case, the sponge 101 prevents the wind roar preventing portion 92 from being deformed. Also, as shown in FIG. 12, the wind roar preventing portion 92 of the third embodiment may be replaced by a wind roar preventing portion 102, which is formed integrally with the elastic insulating member 59. The distal end of the wind roar preventing portion 102 is directed toward the front end 5*a* of the rear door panel 5. This structure increases the strength of the wind roar preventing portion 102, thereby preventing it from being deformed.

In the third embodiment, the wind roar preventing portion 92 extends from the center pillar 7 toward the front end 5*a* of the rear door panel 5, and its distal end is directed to the front end 5*a* of the rear door panel 5. However, the shape of the wind roar preventing portion 92 is not limited to this. For example, the wind roar preventing portion 92 may extend from the fixing portion 59*a* of the elastic insulating member 59 toward the center pillar 7, and its distal end may be directed toward the center pillar 7. This configuration achieves the same advantage as advantage (9) of the third embodiment is obtained. Also, a wind roar preventing portion 92 may be formed integrally with the elastic insulating member 83 of the second embodiment.

In the above illustrated embodiments, the elastic insulating member 59, 83 are both made of urethane resin. However, the elastic insulating member 59, 83 may be formed of any resin material other than urethane resin, as long as it has elasticity and insulating property. The elastic insulating members 59, 83 may be formed by a method other than the extrusion.

The sensor bodies 42, 81, 91 do not need to have the elastic insulating members 59, 83. In this case, the sensor bodies 42, 81, 91 only include the sensor line 51. The hollow insulator 52 is directly fixed to and held by the exposed holding portion 63 of the support member 43 or the holding claws 61*c* of the support member 82.

Figure 13:
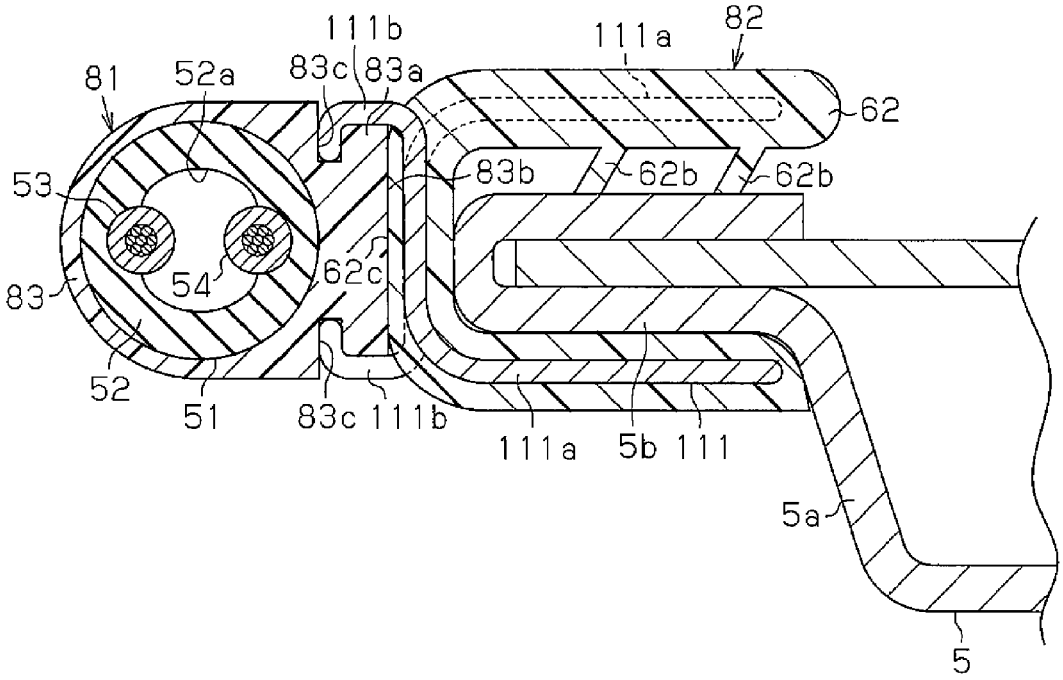
FIG. 13 is a cross-sectional view taken along line A-A of FIG. 2 and illustrating the front end of a door panel to which a support member according to another embodiment is attached.
Figure 14:
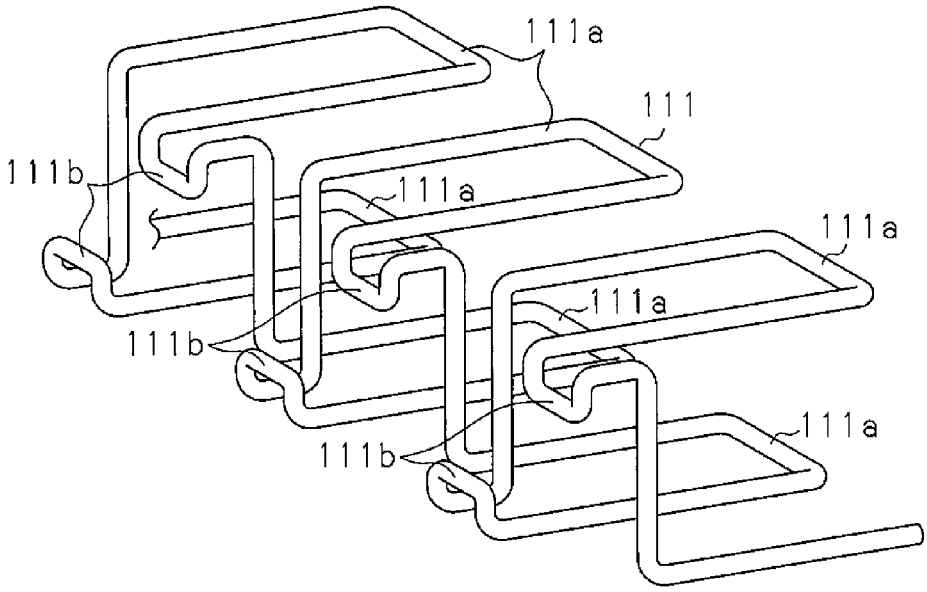
FIG. 14 is a perspective view illustrating a reinforcing member of the support member shown in FIG. 13.

In the second embodiment, the reinforcing member 84 is formed by a metal plate. However, as shown in FIGS. 13 and 14, the reinforcing member 84 may be formed by a single piece of wire. A reinforcing member 111 is formed by bending a single piece of wire at several positions to alternately form reinforcing bodies 111*a* and hook-shaped sensor holding portions 111*b*. The reinforcing bodies 111*a* are embedded in the attachment main body 62 to reinforce the attachment main body 62, and the sensor holding portions 111*b* project outward from the attachment main body 62. A support member 82 having the reinforcing member 111 holds the sensor body 81 by sequentially inserting the sensor holding portions 111*b* into the pair of holding grooves 83*c* from one end in the longitudinal direction of the pair of the holding grooves 83*c* of the sensor body 81. It is therefore easy to form the reinforcing member 111 by simply bending a single piece of wire at several positions in the longitudinal direction. Also, compared to the reinforcing member 84, which is made of a metal plate, the weight of the reinforcing member 111 can be reduced.

In the reinforcing member 84 of the second embodiment, the holding claws 61*c* and the reinforcing extensions 61*b* are formed alternately along the longitudinal direction of the reinforcing core 61*a*. However, the holding claws 61*c* and the reinforcing extensions 61*b* do not need to be formed alternately along the longitudinal direction of the reinforcing core 61*a*. For example, two or more holding claws 61*c* may be located between a pair of the reinforcing extensions 61*b* adjacent to each other in the longitudinal direction. As long as the holding claws 61*c* are formed on both sides in the widthwise direction of the reinforcing core 61*a*, the holding claws

61*c* on one side of the widthwise direction of the reinforcing core 61*a* do not need to face the holding claws 61*c* on the opposite side along the lengthwise direction.

The reinforcing extensions 61*b* and the holding claws 61*c* may be curved relative to the reinforcing core 61*a* to have shapes different from those presented in the above illustrated embodiments.

In the second embodiment, when engaged with the holding grooves 83*c*, the holding claws 61*c* is sequentially inserted into the holding grooves 83*c* from one end in the longitudinal direction of the holding grooves 83*c*. However, the holding claws 61*c* may be engaged with the holding grooves 83*c* from both sides in the widthwise direction of the fixing portion 83*a* while elastically deforming the elastic insulating member 83 and the holding claws 61*c*. Alternatively, the holding claws 61*c* may be bent when being engaged with the holding grooves 83*c*.

The shape of the holding claws 61*c* is not limited to that presented in the second embodiment. For example, the holding claws 61*c* may each be bent only at its proximal portion, so that the part other than the proximal portion is parallel to the reinforcing extension 61*b*. In this case, the holding claws 61*c* are held by the sensor body 81 by being inserted (fitted) into the fixing portion 83*a* of the elastic insulating member 83 from the contact surface 83*b*.

In the first and third embodiments, the sensor bodies 42, 91 are fixed to the exposed holding portion 63 of the support member 43 by means of the double-faced adhesive tape 64. However, the sensor bodies 42, 91 may be fixed to the exposed holding portion 63 of the support member 43 by means of adhesive.

In each of the above illustrated embodiments, two sensing electrodes 53, 54 are held inside the hollow insulator 52 of the sensor line 51. However, four sensing electrodes may be held inside the hollow insulator 52. In this case, the four sensing electrodes are divided into two groups of two sensing electrodes, and the two electrodes in each group are connected to each other in series, and the two sets of the sensing electrodes connected in series are connected to each other in series via the resistor 56.

The sensing electrodes 53, 54 may each be a single piece of wire made of annealed copper.

In the first embodiment, the sensor body 42 is fixed to the front end 5*a* of the rear door panel 5 by means of the support member 43. However, the sensor body 42 may be fixed to a part of the periphery of the door opening 4 that faces the front end 5*a* of the rear door panel 5, that is, the center pillar 7 by means of the support member 43. This configuration may also be applied to the sensor body 81 of the second embodiment and the sensor body 91 of the third embodiment.

In the above illustrated embodiments, when receiving a contact detection signal, the door ECU 71 reverses the slide actuator 25, thereby opening the rear door panel 5 by a predetermined amount and then stops the slide actuator 25. However, the door ECU 71 may be configured such that, when receiving the contact detection signal, the door ECU 71 stops the slide door actuator 25. Alternately, when receiving the contact detection signal, the door ECU 71 may reverse the slide actuator 25 to move the rear door panel 5 to the fully open position Po, and then stop the slide actuator 25.

In the above illustrated embodiments, the energization detecting portion 44 supplies a current at a constant voltage to the sensing electrode 53, and outputs a contact detection signal when detecting a change in the current value caused by contact between the sensing electrodes 53, 54. However, the energization detecting portion 44 may be configured to output a contact detection signal when detecting a change in the voltage value caused by contact between the sensing electrodes 53, 54.

Figure 15A:
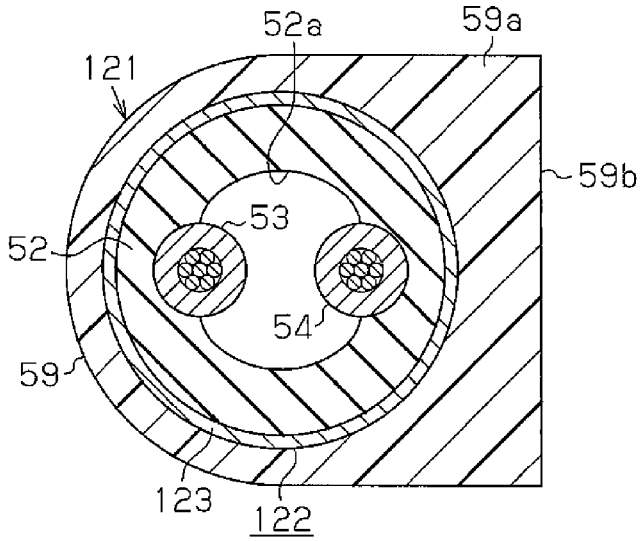
FIG. 15A is a cross-sectional view taken along line A-A of FIG. 2 and illustrating a sensor body according to another embodiment.
Figure 15B:
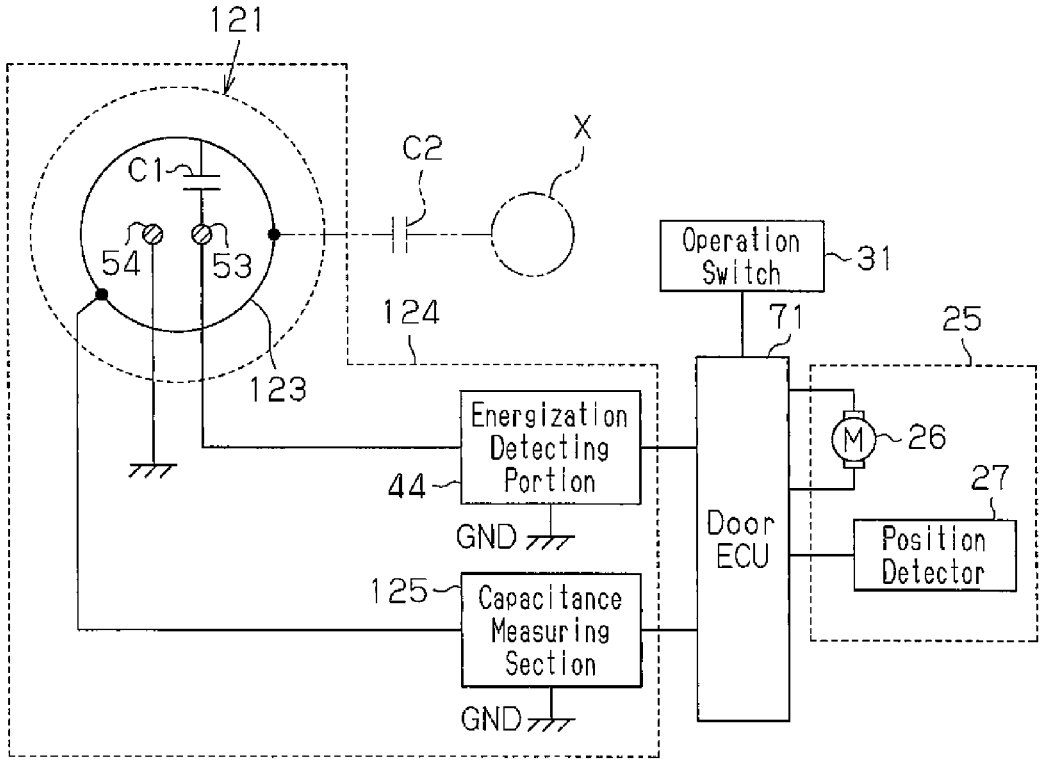
FIG. 15B is a block diagram showing the electrical structure of a power sliding door apparatus equipped with the sensor body shown in FIG. 15A.

In the above illustrated embodiments, the sensor bodies 42, 81, 91 are configured to perform contact detection of an object X. However, the power sliding door apparatus 1 may have a sensor body 121 shown in FIGS. 15A and 15B, which has an approach detecting function, in addition to the contact detecting function. The sensor body 121 detects approach of an object X to the sensor body 121. The sensor body 121 has a sensor line 122 and an elastic insulating member 59 according to the first embodiment coating the outer circumference of the sensor line 122. The sensor line 122 includes a hollow insulator 52, sensing electrodes 53, 54, and a conductive and flexible approach sensing electrode 123, which is provided to coat the outer circumference of the hollow insulator 52. The elastic insulating member 59 is substantially formed integrally with the approach sensing electrode 123 so that no clearance exists between the elastic insulating member 59 and the outer circumferential surface of the sensor line 122, or the outer circumferential surface of the approach sensing electrode 123. An object detecting device 124 having the sensor body 121 includes an energization detecting portion 44 and a capacitance measuring section 125. The capacitance measuring section 125 is electrically connected to the door ECU 71, and to the approach sensing electrodes 123. The capacitance measuring section 125 measures a capacitance C1 at normal time between the approach sensing electrode 123 and the sensing electrode 53 (that is, when there is no object X approaching the sensor body 121), and the capacitance (C1-C2) at the time when a stray capacitance C2 is generated as an object X approaches the sensor body 121. When detecting an increase in the stray capacitance C2, the capacitance measuring section 125 outputs an approach detecting signal. When receiving an approach detecting signal, the door ECU 71 controls the slide actuator 25 to stop or open the rear door panel 5. The contact detecting function performed by the object detecting device 124 is the same as that described above. The object detecting device 124 may only execute the approach measuring function.

In the above illustrated embodiments, the present invention is applicable to a power sliding door apparatus 1, which opens and closes a door opening 4 using a rear door panel 5 provided on a side of a vehicle 2. However, the present invention may be applied to any type of opening and closing apparatus, as long as the apparatus opens and closes an opening using an opening and closing body actuated by driver force, for example, from a motor. For example, the object detecting device 41 of the illustrated embodiments may be used in an opening and closing apparatus that electrically opens and closes a backdoor provided at the rear of a vehicle.

What is claimed is:

1. An opening and closing apparatus comprising:

an opening and closing body that is actuated to selectively open and close an opening;

a force transmitting portion having a drive portion, the force transmitting portion transmitting drive force from the drive portion to the opening and closing body;

an elongated sensor body for detecting an object between a closing-side end of the opening and closing body and a facing part of the periphery of the opening that faces the closing-side end of the opening and closing body, the closing-side end being at an advancing side of the opening and closing body when the opening and closing body is in a closing operation;

an elongated support member fixed either to the closing-side end or the facing part, the support member being formed independently from the sensor body and supporting the sensor body;

a control section that controls the drive portion based on a detection result of the object received from the sensor body; and a double-faced adhesive tape that fixes the sensor body to the support member, wherein the support member includes an attachment main body made of an insulating resin material and a reinforcing member that is embedded in the attachment main body and reinforces the attachment main body, the reinforcing member has a sensor holding portion that is exposed to an outside from the attachment main body, and the double-faced adhesive tape is provided between the sensor holding portion and the sensor body.

2. The opening and closing apparatus according to claim 1, wherein the reinforcing member includes an elongated reinforcing core that extends along a longitudinal direction of the support member, and the reinforcing core is exposed to the outside from the attachment main body so as to function as the sensor holding portion.

3. The opening and closing apparatus according to claim 1, wherein the reinforcing member includes:

an elongated reinforcing core that extends along the longitudinal direction of the support member; and a plurality of reinforcing extensions that extend from both sides in a widthwise direction of the reinforcing core at several positions along the longitudinal direction of the reinforcing core, the reinforcing extensions being bent or curved relative to the reinforcing core.

4. The opening and closing apparatus according to claim 1, wherein the sensor body includes:

a sensor line having a plurality of sensing electrodes, the sensing electrodes being separated from each other and facing each other inside a hollow insulator having elasticity and an insulating property, and when the sensing electrodes contact each other due to elastic deformation of the hollow insulator, at least one of a current value and a voltage value of current flowing between the sensing electrodes changes; and an elastic insulating member that has elasticity and an insulting property, the elastic insulating member being integrated with the sensor line such that no clearance exists between the elastic insulating member and the outer circumferential surface of the sensor line, the elastic insulating member having a held portion that is held by the sensor holding portion.

5. The opening and closing apparatus according to claim 4, wherein the elastic insulating member is formed of a urethane resin.

6. The opening and closing apparatus according to claim 4, wherein a wind roar preventing portion is formed integrally with the elastic insulating member, and the wind roar preventing portion is located between the closing-side end of the opening and closing body and the facing part when the opening and closing body closes the opening, the wind roar preventing portion preventing wind roar generated by wind flowing on the side of the opening and closing body.

7. The opening and closing apparatus according to claim 6, wherein the support member is fixed to the closing-side end, and the wind roar preventing portion extends toward the closing-side end, and the distal end of the wind roar preventing portion is directed to the closing side end.

* * * * *